US007312598B1

(12) United States Patent
Huang

(10) Patent No.: US 7,312,598 B1
(45) Date of Patent: Dec. 25, 2007

(54) CAPACITOR FREE LOW DROP OUT REGULATOR

(75) Inventor: Shengming Huang, Gourock (GB)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 11/467,520

(22) Filed: Aug. 25, 2006

(51) Int. Cl.
*G05F 1/00* (2006.01)

(52) U.S. Cl. ..... 323/280; 323/281; 323/273; 323/316; 323/226; 323/277; 330/253; 330/255; 330/259; 330/261

(58) Field of Classification Search ..... 323/280, 323/281, 316, 274, 275, 279, 226, 277; 330/255, 330/253, 259, 261
See application file for complete search history.

(56) References Cited

U.S. PATENT DOCUMENTS

| | | | | |
|---|---|---|---|---|
| 5,939,870 | A | 8/1999 | Nguyen et al. | |
| 6,005,440 | A * | 12/1999 | Okamoto | 330/253 |
| 6,603,294 | B2 * | 8/2003 | Morita | 323/280 |
| 6,661,210 | B2 * | 12/2003 | Kimball et al. | 323/268 |
| 7,106,136 | B2 * | 9/2006 | Moon et al. | 330/261 |
| 2005/0017809 | A1 * | 1/2005 | Ueno | 330/255 |
| 2007/0040536 | A1 * | 2/2007 | Smith et al. | 323/280 |

OTHER PUBLICATIONS

Hazucha et al.: "Area-Efficient Linear Regulator With Ultra-Fast Load Regulation," IEEE Journal of Solid-State Circuits, vol. 40, No. 4, Apr. 2005, pp. 933-940.
Leung et al.: "A Capacitor-Free CMOS Low-Dropout Regulator with Damping-Factor-Control Frequency Compensation," IEEE Journal of Solid-State Circuits, vol. 38, No. 10, Oct. 2003, pp. 1691-1702.
TPS732xx Datasheet: Cap-Free, NMOS, 250mA Low Dropout Regulator with Reverse Current Protection, Texas Instruments Incorporated, 27 pages, Revised May 2007, Dallas, Texas.

* cited by examiner

*Primary Examiner*—Bao Q. Vu
*Assistant Examiner*—Stuart Hansen
(74) *Attorney, Agent, or Firm*—Darby & Darby P.C.; Davin Chin

(57) ABSTRACT

A low drop out (LDO) regulator that includes a novel error amplifier, which is arranged with a first stage that employs both NMOS and PMOS devices that are similarly doped in differential pairs and a second stage that operates with NMOS and PMOS devices in a push-pull arrangement. In addition to the error amplifier, the LDO regulator can also include a startup circuit coupled to an enable voltage, a reference filter circuit coupled to a reference voltage, an output circuit, a quiescent current control circuit, and a pulse generator circuit. Also, an internal RC network is provided to compensate for phase shift. The integrated operation of the components of the regulator enables stable and fast operation of an LDO regulator with no external capacitors connected to the input or output terminals.

21 Claims, 5 Drawing Sheets

Phase Margin at Vin = 5.5V

CAPACITOR FREE LOW DROP OUT REGULATOR

FIELD OF THE INVENTION

The invention is generally directed to trimming the operation of electronic components, and more particularly, a low drop out regulator that provides superior performance without an external capacitor.

BACKGROUND OF THE INVENTION

An integrated electronic circuit arranged as a regulator often includes several electronic components that enable the regulator's functionality. The actual operation of a particular regulator can vary based on a variety of factors, including manufacturing processes, and component layout. For relatively high performance and stable operation, low drop out (LDO) regulators often employ external capacitors at both the input and output interfaces. However, the equivalent series resistance (ESR) and capacitance of these external capacitors can adversely affect the stability of the regulator.

However, external capacitors can constrain how a regulator is used in some applications. For example, externally connected capacitors can increase the surface area (space) required to mount a regulator on a circuit board/PCB for an electronic device. Also, some regulators can specify their use with a particular type of external capacitor with a relatively low ESR. Although some regulators have been provided that don't require some type of external capacitor on the input and/or output interfaces, these "capacitor free" regulators have had difficulty handling loads greater than 100 milliamps and maintaining relatively stable voltage regulation.

BRIEF DESCRIPTION OF THE DRAWINGS

For a better understanding of the present invention, reference will be made to the following detailed description, which is to be read in association with the accompanying drawings, wherein.

DETAILED DESCRIPTION OF CERTAIN EMBODIMENTS

Figure 1:
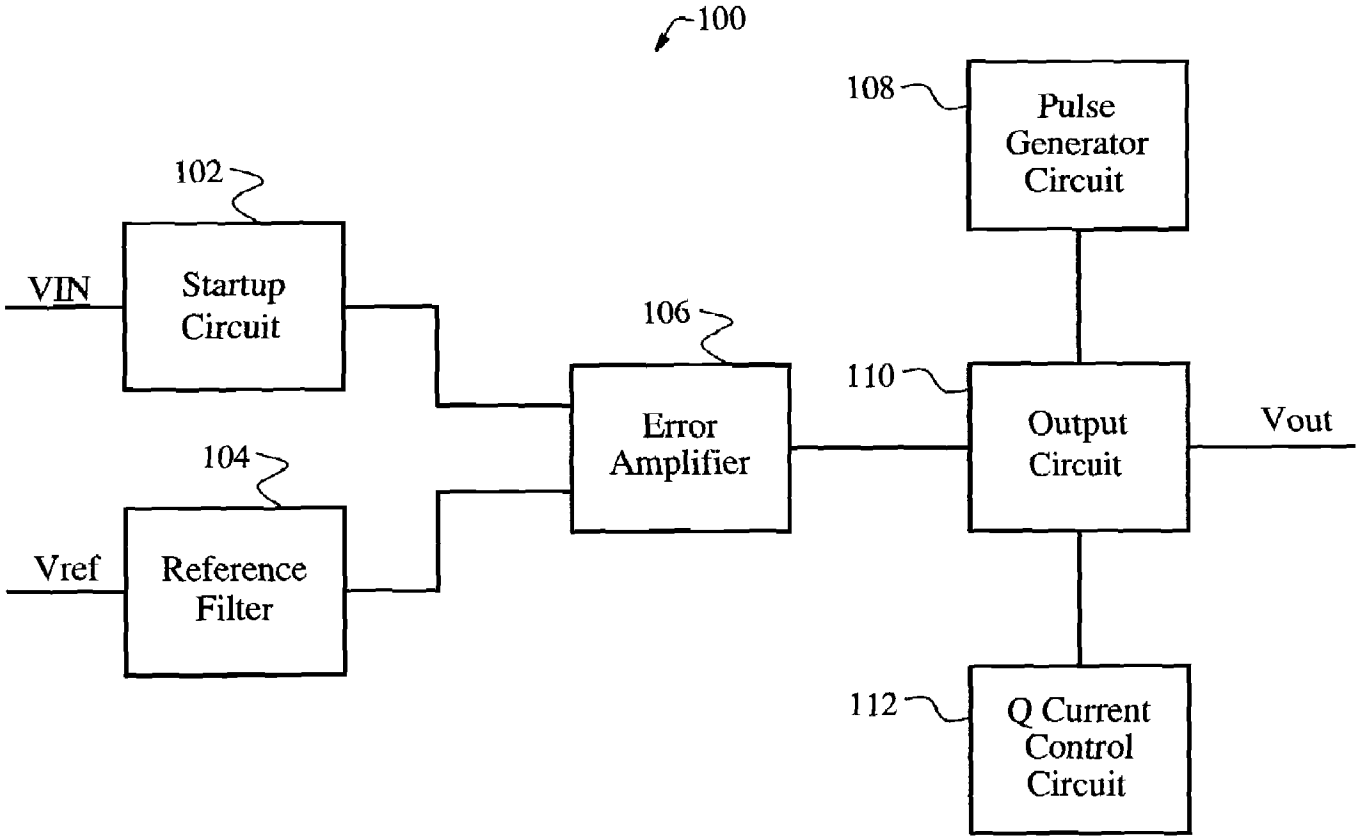
FIG. 1 illustrates a block diagram of components included in an integrated circuit regulator.

In the following detailed description, reference is made to the accompanying drawings, in which are shown exemplary but non-limiting and non-exhaustive embodiments of the invention. These embodiments are described in sufficient detail to enable those having skill in the art to practice the invention, and it is understood that other embodiments may be used, and other changes may be made, without departing from the spirit or scope of the invention. The following detailed description is, therefore, not to be taken in a limiting sense, and the scope of the invention is defined only by the appended claims. In the accompanying drawings, like reference numerals refer to like parts throughout the various figures unless otherwise specified.

Briefly, the invention is directed to a low drop out (LDO) regulator that includes an error amplifier with a novel architecture. This error amplifier further includes a first stage with both NMOS and PMOS differential pairs, and a second stage that operates in a push-pull arrangement. In addition to the error amplifier, the LDO regulator can also include a startup circuit coupled to an enable/input voltage, a reference filter circuit coupled to a reference voltage, an output circuit, a quiescent current control circuit, and a pulse generator circuit.

Also, in operation, some of the regulator's components are disabled during low load current states, such as stand by, so that a relatively low quiescent current is generated/controlled and relatively less power is consumed. Also, a relatively brief but high bias current is provided with a voltage pulse during high/low load current transitions to further stabilize the operation of the regulator. Additionally, internal RC networks are arranged to provide phase compensation and eliminate a need for external capacitors connected to the input and output terminals. The novel regulator can provide a relatively fast, stable, effective, and efficient response to varying load current states in part because the complimentary differential pairs of the error amplifier's first stage work in concert with the push pull effect of the second stage for both low and high load current states.

FIG. 1 illustrates a block diagram of an exemplary embodiment of LDO voltage regulator 100, which can operate efficiently and effectively without external capacitors coupled to its input or output terminals. Regulator 100 includes startup circuit 102, which is coupled to an input voltage and error amplifier 106. Reference filter 104 is coupled to a reference voltage and error amplifier 106. Amplifier 106 is coupled to output circuit 110, which is coupled to an output voltage interface. Also, as shown, quiescent current control circuit 112 and pulse generator circuit 108 are coupled to output circuit 110.

Additionally, although not shown, error amplifier 106 is arranged with a first stage of PMOS and NMOS differential pair transistors and a second stage configured in a push-pull manner. Also, quiescent current control circuit 112 is provided for operation in relatively low load current states, e.g., less than approximately 0.5 milliamps. Further, pulse generator circuit 108 is provided for smoothing high/low load transitions in regulator 100. In this way, regulator 100 can operate in a relatively stable and efficient manner without the use of external capacitors coupled to its input or output terminals.

Figure 2A:
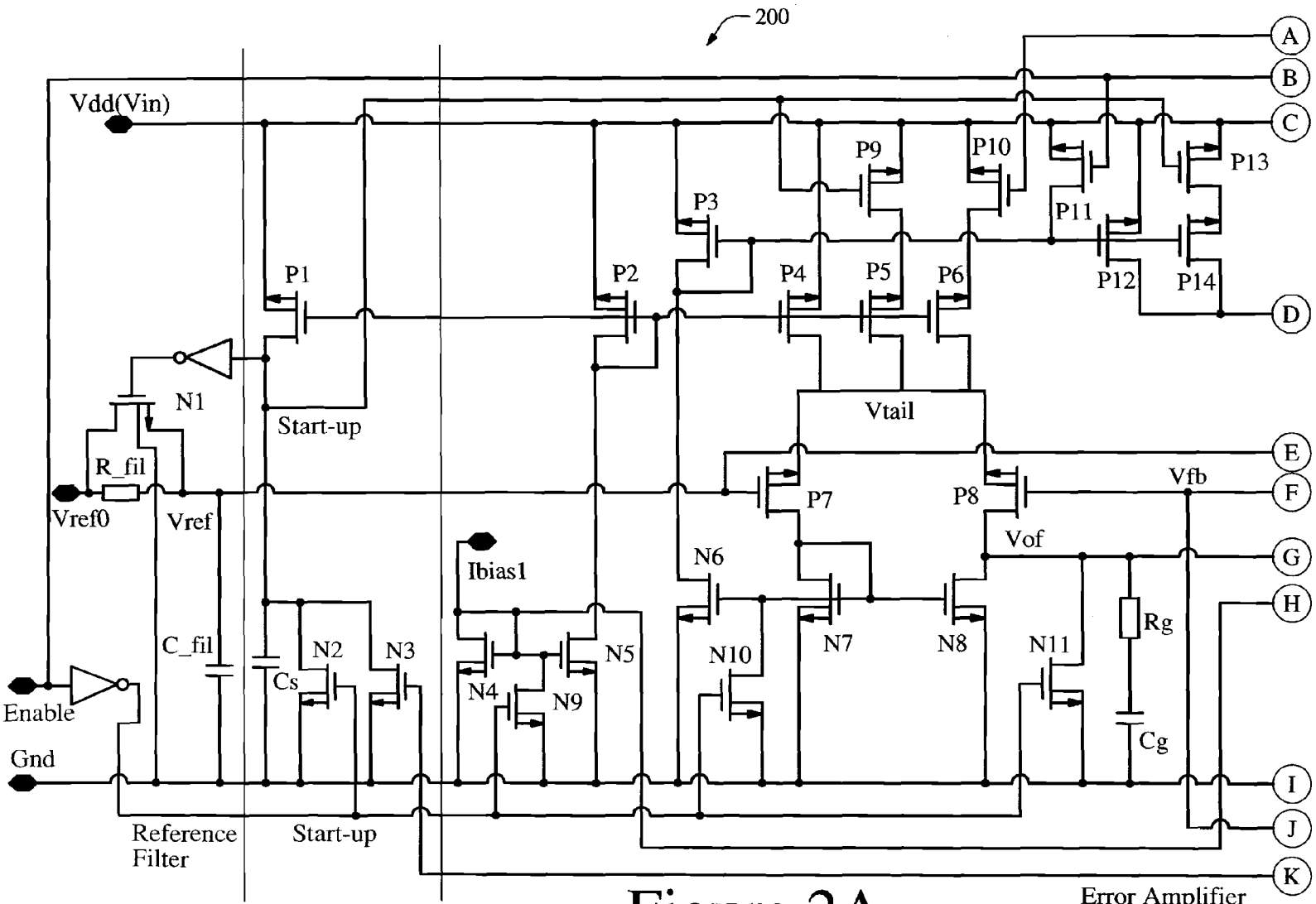
FIGS. 2A and 2B show a schematic diagram of one embodiment of a capacitor free low drop out regulator.
Figure 2B:
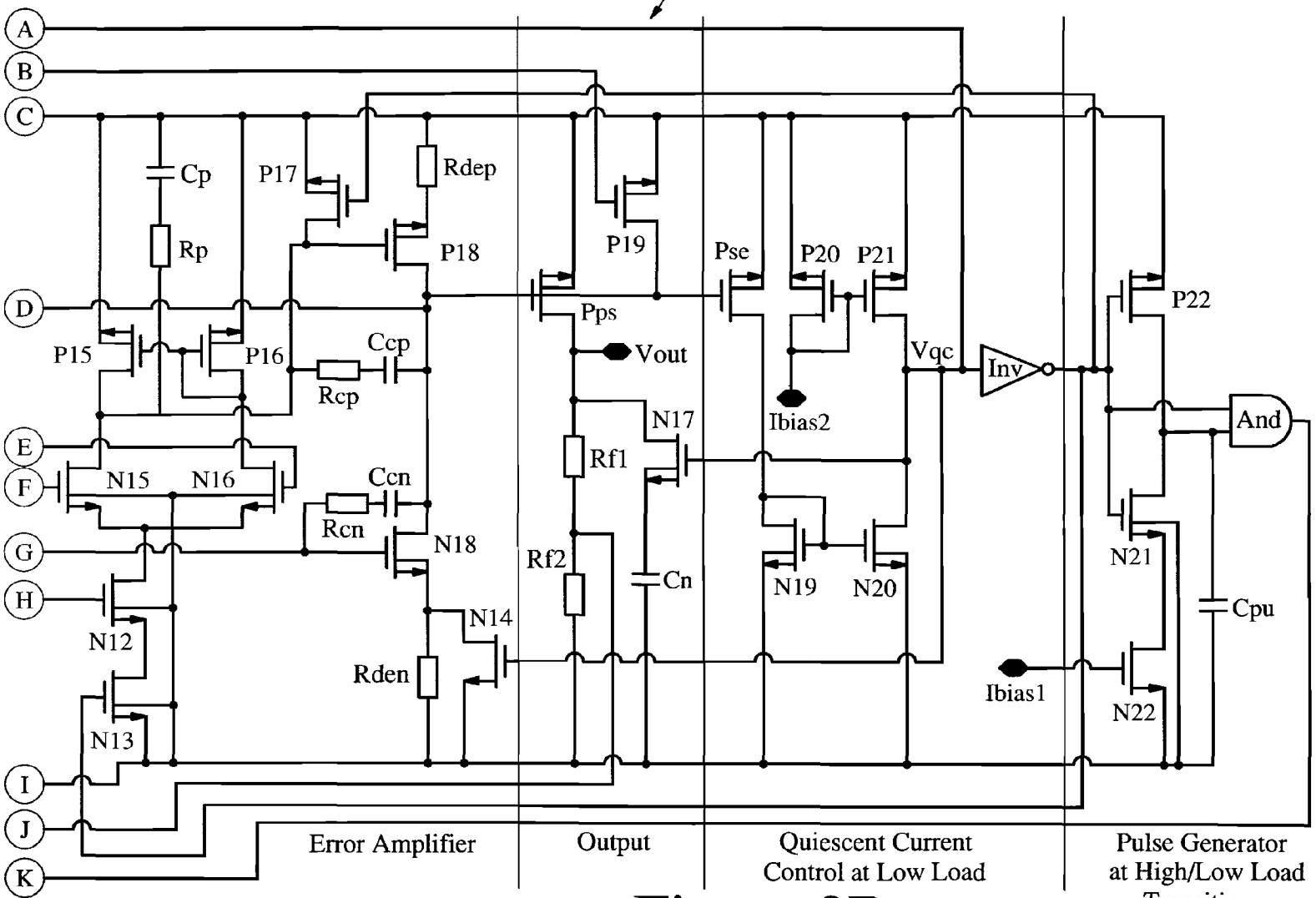

FIGS. 2A and 2B in combination illustrate a schematic diagram of an exemplary embodiment of LDO regulator 200 which provides relatively high performance while operating without external capacitors coupled to its input or output terminals/interfaces. As shown, regulator 200 is arranged with several sub-circuits or components, including reference filter, startup, error amplifier, output, quiescent current control (for low load current states), and pulse generator (for smoothing high/low load current transitions).

In regard to the startup sub-circuit, once an enable signal is provided, PMOS transitor P1 starts charging up capacitor Cs which causes the Vstart-up voltage to increase in such a way that the voltage at the Start_Up node also increases somewhat gradually from approximately zero volts (ground) to the voltage provided at terminal VIN. In one embodiment, if the capacitance of capacitor Cs is approximately 5 picofarads, then the gradual increase can occur over a time period of approximately 600 microseconds, and the like.

In regard to the reference filter, resistor R_fil can be implemented with a voltage controlled MOSFET that is arranged for a relatively high equivalent resistance. Furthermore, in at least one embodiment NMOS transistor N1 can be connected in parallel to enable a relatively fast and stable turn on (start-up) based on the reference voltage Vref.

In regard to the quiescent current control sub-circuit, PMOS transistor Pse is arranged to sense a relatively low load current, e.g., approximately 0.5 milliamps, and the like. Also, in a low load current state, voltage Vqc is set logically "high", e.g., approximately the voltage of Vdd. By sensing this low load current state, such as a standby state, the operation of the regulator can be arranged to generate a relatively low quiescent current by disabling some components, and thereby consume less power. However, in a higher load current state, voltage Vqc is set logically "low" (zero volts/ground) so that any components disabled for the low load state are quickly enabled for full operation.

In regard to the pulse generator, a positive voltage pulse is typically generated to discharge the voltage Vstart-up through NMOS transistor N3 whenever voltage Vqc transitions from a "low" state to a "high" state. For example, voltage Vqc could be arranged to transition from a "low" to a "high" when the load current correspondingly transitions from approximately more than 0.5 milliamps to relatively less than 0.5 milliamps. The positive voltage pulse provided by the pulse generator assists in stabilizing the operation of the error amplifier in part because it enables a relatively high bias current for a relatively short period of time that it is needed, i.e., during a high/low load current transition. Also, in at least one embodiment, capacitor Cpu can be arranged with a capacitance of approximately 2 picofarads.

In regard to the output stage sub-circuit, PMOS transistor Pps is typically arranged as a pass device and implemented with a power transistor that is connected to the output terminal VOUT. $R_{f1}$ and $R_{f2}$ are arranged as feedback resistors for generating output feedback voltage to one of the inputs of the error amplifier. Also, capacitor C1 is only connected via NMOS transistor N17 under low load current state (less than approximately 0.5 milliamps) for generating a dominant pole at the output terminal VOUT. Also, in at least one embodiment, the capacitance of $C_{11}$ is approximately 10 picofarads.

The error amplifier is arranged with two stages. The first stage is configured with two types of differential MOS transistor pairs, i.e., NMOS transistors N15 and N16 and PMOS transistors P7 and P8, which are arranged to operate in a complementary manner. Also, in a low load current state, the NMOS different input pair (NMOS transistors N15 and N16) can be disabled to reduce quiescent current and consume less power. Additionally, the error amplifier's second stage is arranged to provide a relatively fast push-pull effect by the complementary operation of at least NMOS transistor N18 and PMOS transistor P18.

The error amplifier includes at least four RC networks that provide internal phase compensation by the arrangement of (1) Resistor Rg with Capacitor Cg; (2) Resistor Rp with Capacitor Cp; (3) Resistor Rcn with Capacitor Ccn; and (4) Resistor Rcp with Capacitor Ccp. Also, in at least one embodiment, the capacitance of the capacitors in these RC networks is approximately 10 picofarads. Further, the integrated operation of the error amplifier's components (sub-circuits, stages, RC networks, and the like) enables a relatively fast transient response speed for both low and high current loads without having external capacitors connected to the regulator's input and output terminals.

Resistors Rden and Rdep are configured as cascode degeneration resistances. This cascode degeneration arrangement enables relatively higher output resistances for NMOS transistor N18 and PMOS transistor P18, respectively. Consequently, a dominate pole is typically generated at the output node of the second stage under a higher load current state, e.g., greater than approximately 0.5 milliamps. If the load current is relatively low, e.g., less than approximately 0.5 milliamps, these two degeneration resistances are short connected by NMOS transistor N14 and PMOS transistor P17, respectively, to enable a relatively low output resistance at the second stage's output node.

PMOS transistors pair P9 and P5 and PMOS transistor pair P13 and P14 are arranged to provide a relatively high, but relatively brief, bias current during startup. The relatively large bias current during startup further enables the relatively stable operation of exemplary regulator 200.

Additionally, PMOS transistors P10 and P17 and NMOS transistor N13 can be arranged to provide a relatively low quiescent current in a low load current state, e.g., less than approximately 0.5 milliamps. Under a low load current state, PMOS transistor P6 can be effectively disabled by PMOS transistor P10. Typically, the width/length of PMOS transistor P4 is much smaller than PMOS transistor P6, and both of their ratios are related to that of PMOS transistor P2.

Also, in a low load current state, the NMOS different input pair (NMOS transistors N15 and N16) can be disabled by the operation of PMOS transistor P17 and NMOS transistor N13. Under these low load current states, PMOS transistor P12 and NMOS transistor N18 can be arranged as the second stage of the error amplifier. Additionally, if the load current transitions from low to high, disabled components are enabled and the quiescent current rises. However, this increase in quiescent current is typically relatively insignificant in comparison to the relatively higher load current driving a relatively larger load.

Figure 3:
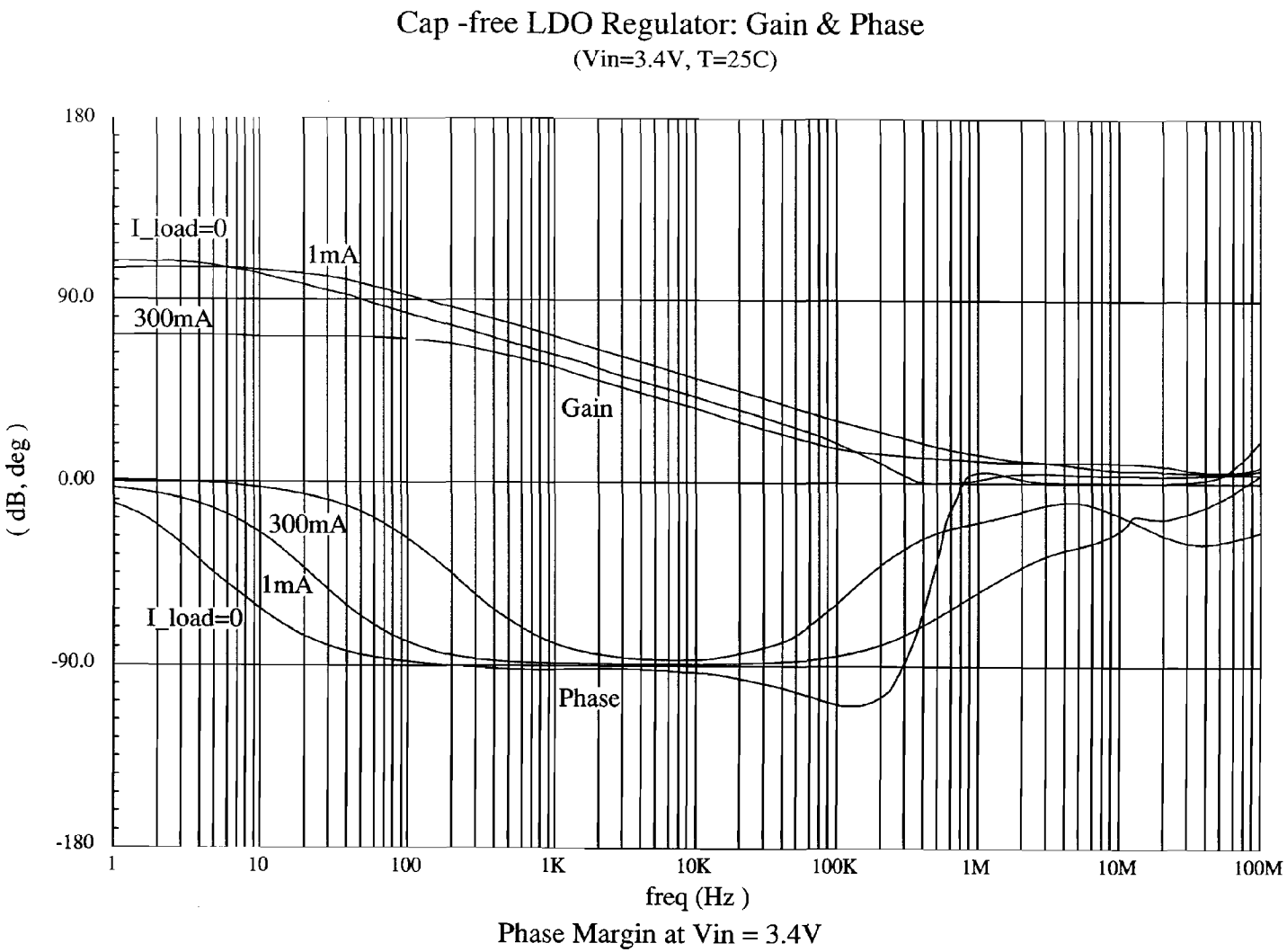
FIG. 3 illustrates a graph showing the phase margin for one embodiment of the invention operating at an input voltage of 3.4 volts.
Figure 4:
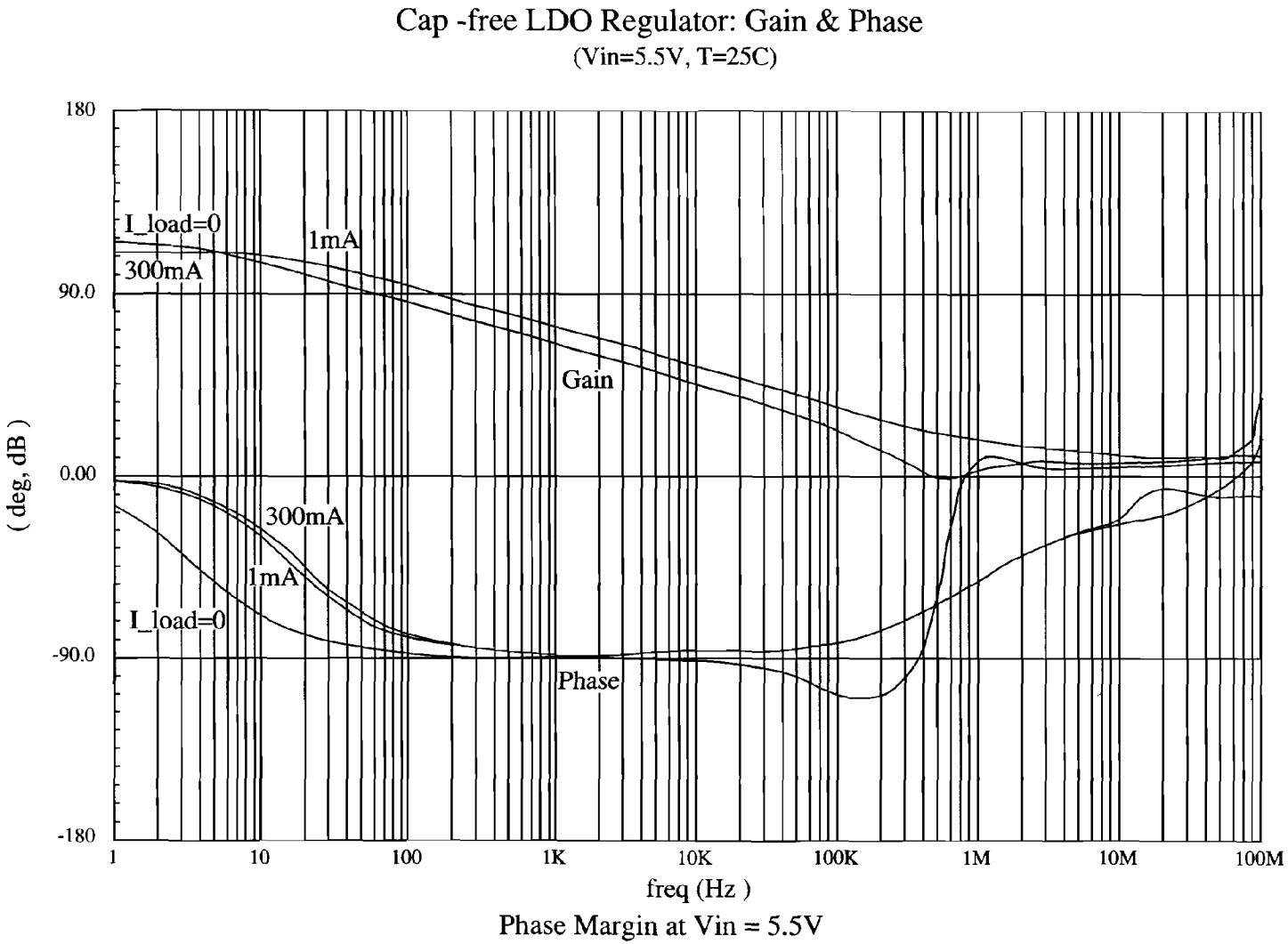
FIG. 4 shows another graph illustrating the phase margin for certain embodiments of the invention operating at an input voltage of 5.5 volts, in accordance with the invention.

FIG. 3 is a graph of the phase margin for at least one embodiment (Vout=3.3V) over various loads with input voltage VIN at 3.4 volts. Similarly, FIG. 4 is a graph of the phase margin for certain embodiment (Vout=3.3V) over various loads with input voltage VIN at 5.5 volts. As shown, the phase margin is at least 60 degrees for varying loads with different input voltages. Also, the embodiments are relatively stable during load transient states, i.e., fast changes that occur between high/low load current states. Additionally, in at least some of the embodiments, the quiescent current is approximately 60 microamps or less.

Accordingly, the above specification, examples, and data provide a complete description of the manufacture and use of the composition of the invention. Since many embodiments of the invention can be made without departing from the spirit and scope of the invention, the invention resides in the claims hereinafter appended.

What is claimed as new and desired to be protected by Letters Patent of the United States is:

1. A regulator for regulating an output voltage, comprising:

an input circuit that is arranged to receive at least an input voltage and a reference voltage;

an error amplifier that further includes:

a first stage that includes two PMOS transistors and two NMOS transistors that are separately arranged as differential pairs, wherein the input voltage and the reference voltage are comparable by at least these two differential pairs, and wherein the NMOS transistor differential pair is disabled if a low load current state is sensed at an output terminal;

a second stage that includes a PMOS transistor and an NMOS transistor arranged in a push pull configuration to provide the output voltage based on the comparison of the input voltage and the reference voltage, wherein the PMOS transistor differential pair is arranged to provide the comparison of the input voltage and the reference voltage to the second stage during at least a portion of the time that the NMOS transistor differential pair is disabled; and a phase compensator that includes at least one resistive-capacitive (RC) network that compensates at least the output voltage for phase shift, wherein each component of the phase compensator is disposed within the regulator; and an output circuit that is coupled to the output terminal to provide the output voltage to a load.

2. The regulator of claim 1, wherein the input circuit further comprises a startup circuit that is arranged to provide the ramping of a starting voltage for initially energizing at least one component of the regulator in response to an enable signal, and wherein the starting voltage is provided by a gradual charging of at least one capacitor.

3. The regulator of claim 2, further comprising a pulse generator that is arranged to provide a voltage pulse that turns off the starting voltage by discharging the at least one capacitor, wherein the voltage pulse further provides a relatively brief and high bias current during a transition between a low load current state and a high load current state.

4. The regulator of claim 3, wherein the voltage pulse provides a relatively high bias current for a relatively short period of time during at least one transition between the high load current state and the low load current state.

5. The regulator of claim 1, further comprising a reference filter that includes a resistive element with a relatively high equivalent resistance, wherein in response to the enable signal, the resistive element provides smooth stabilization of a reference voltage that is provided to the regulator.

6. The regulator of claim 1, wherein the output circuit includes a power transistor that is arranged as a pass device for the output current to the load, and wherein a capacitor is only connected via one NMOS transistor under low load current state for generating a dominant pole at the output terminal.

7. The regulator of claim 1, wherein the output circuit includes at least one component that is configured as a cascode degeneration resistance in response to a high load current state for having high output resistance to occur at an output of the second stage, wherein the cascode degeneration resistance is further disabled for a relatively low output resistance to occur at an output of the second stage during the low load current state.

8. The regulator of claim 1, further comprising a quiescent current circuit that includes a component for sensing the low load current state and a high load current state, wherein the quiescent current circuit provides a signal for the low load state that disables at least a portion of other components in the regulator, and wherein a quiescent current generated by the regulator during the low load current state is subsequently reduced.

9. The regulator of claim 8, wherein the quiescent current circuit provides another signal during the sensing of the high load current state that enables the operation of at least a portion of the disabled other components in the regulator.

10. The regulator of claim 1, wherein the phase compensator includes a plurality of resistive-capacitive (RC) networks that are arranged to compensate for at least phase shift in the error amplifier.

11. A voltage regulator for controlling an output voltage, comprising:

an input circuit that is arranged to receive at least an input voltage and a reference voltage, wherein the input circuit is arranged to provide the ramping of a starting voltage for initially energizing at least one component of the voltage regulator in response to an enable signal;

an error amplifier that further includes:

a first stage that includes two differently doped pairs of similarly doped transistors that are arranged as complementary differential pairs, wherein at least a portion of the input voltage and the reference voltage are comparable by at least these two differential pairs, and wherein at least a first one of the differential pairs is disabled if a low load current state is sensed at an output terminal;

a second stage that includes two dissimilarly doped transistors that are arranged in a push pull configuration to provide the output voltage based on the comparison of the input voltage and the reference voltage, wherein a second one of the differential pairs is arranged to provide the comparison of the input voltage and the reference voltage to the second stage during at least a portion of the time that the first one of the differential pairs is disabled; and a phase compensator that includes at least one network of at least one active component and one passive component that compensates at least the output voltage for phase shift, wherein each component of the phase compensator is disposed within the regulator; and an output circuit that is coupled to the output terminal to provide the output current to a load.

12. The voltage regulator of claim 11, wherein the network further comprises at least one of a capacitive component or an inductive component.

13. The voltage regulator of claim 12, further comprising a pulse generator that is arranged to provide a voltage pulse that turns off the starting voltage by discharging the at least one capacitor, and wherein the voltage pulse further provides a relatively brief and high bias current during a transition between a high load current state and a low load current state.

14. The voltage regulator of claim 13, wherein the voltage pulse provides a relatively high bias current for a relatively short period of time during at least one transition between the high load current state and the low load current state.

15. The voltage regulator of claim 11, further comprising a resistive element with a relatively high equivalent resistance, wherein in response to the enable signal, the resistive element filters glitches from the reference voltage.

16. The voltage regulator of claim 11, wherein the output circuit includes a power transistor that is arranged to provide a capacitance for a dominant pole generated at the error amplifier's output terminal under high load current state, and wherein the power transistor is arranged as a pass device for the output current/voltage to the load.

17. The voltage regulator of claim 11, wherein the output circuit includes a cascode degeneration resistance that operates in response to a high load current state for generating a relatively high output resistance at an output of the second stage, wherein the cascode degeneration resistance is further disabled for a relatively low output resistance to occur at an output of the second stage during the low load current state.

18. The voltage regulator of claim 11, further comprising a control circuit that includes a component for sensing the low load current state and a high load current state, wherein the circuit provides a signal for the low load state that disables at least a portion of other components in the voltage regulator, and wherein a quiescent current generated by the regulator during the low load state is subsequently reduced.

19. The voltage regulator of claim 18, wherein the control circuit provides another signal during the sensing of the high load current state that enables the operation of at least a portion of the disabled other components in the voltage regulator.

20. A voltage regulator for controlling an output voltage, comprising:

a means for receiving at least an input voltage and a reference voltage, wherein the input circuit is arranged to provide the ramping of a starting voltage for initially energizing at least one component of the voltage regulator in response to an enable signal;

an error amplifier that further includes:

a means for separately arranging two complementary differential pairs, wherein at least a portion of the input voltage and the reference voltage are comparable by at least these two differential pairs, and wherein at least a first one of the differential pairs is disabled if a low load current state is sensed at an output terminal;

a means for a push pull configuration that provides a representation of the output voltage based on the comparison of the input voltage and the reference voltage, wherein a second one of the differential pairs is arranged to provide the comparison of the input voltage and the reference voltage to the means for the push pull configuration at least a portion of the time that the first one of the differential pairs is disabled; and a means for compensating for phase shift with at least one resistive-capacitive (RC) network, wherein each component of the network is disposed within the voltage regulator; and a means for providing the output current/voltage to a load at the output terminal.

21. The regulator of claim 1, wherein the at least one RC networks includes a first RC network and a second RC network, and wherein the first RC network includes a first resistor that is coupled in series to a first capacitor, the first capacitor is further coupled to the output of the second stage, and the first resistor is further coupled to the gate of the PMOS transistor of the second stage, and wherein the second RC network includes a second resistor that is coupled in series to a second capacitor, the second capacitor is further coupled to the output of the second stage, and the second resistor is further coupled to the gate of the NMOS transistor of the second stage.

* * * * *

UNITED STATES PATENT AND TRADEMARK OFFICE

CERTIFICATE OF CORRECTION

PATENT NO. : 7,312,598 B1
APPLICATION NO. : 11/467520
DATED : December 25, 2007
INVENTOR(S) : Huang It is certified that error appears in the above-identified patent and that said Letters Patent is hereby corrected as shown below:

In column 2, line 60, delete "transitor" and insert -- transistor --, therefor.

In column 3, line 38, delete "C1" and insert -- $C_{11}$ --, therefor.

Signed and Sealed this

Twenty-ninth Day of April, 2008

JON W. DUDAS
*Director of the United States Patent and Trademark Office*